United States Patent [19]

Varner et al.

[11] Patent Number: 4,883,146

[45] Date of Patent: Nov. 28, 1989

[54] DESCENT CONTROL DEVICE WITH DEADMAN BRAKE

[75] Inventors: Horace M. Varner; Ernest L. Stech, both of Littleton, Colo.

[73] Assignee: Frost Engineering Development Corporation, Englewood, Colo.

[21] Appl. No.: 292,294

[22] Filed: Dec. 30, 1988

[51] Int. Cl.[4] ..... A62B 1/14; B65H 59/14

[52] U.S. Cl. ..... 182/5; 188/65.2; 188/65.5

[58] Field of Search ..... 188/65.1, 65.2, 65.4, 188/65.5; 182/5, 6, 7; 160/178.2

[56] References Cited

U.S. PATENT DOCUMENTS

| | | | |
|---|---|---|---|
| 147,828 | 2/1874 | de Boucherville . | |
| 289,050 | 11/1883 | Wilcox . | |
| 292,981 | 2/1884 | Brooke . | |
| 386,237 | 7/1888 | Budd . | |
| 387,650 | 8/1888 | Lovejoy . | |
| 536,866 | 4/1895 | Fitzgerald . | |
| 720,310 | 2/1903 | Wyss-Baumgartner . | |
| 771,251 | 10/1904 | Howe . | |
| 779,550 | 1/1905 | Leffelman | 188/65.2 |
| 899,984 | 9/1908 | Huffman et al. . | |
| 1,103,849 | 7/1914 | Stenborg . | |
| 1,115,603 | 11/1914 | Smith . | |
| 1,187,754 | 6/1916 | Lyra . | |
| 1,351,734 | 7/1920 | Barrington . | |
| 1,591,584 | 7/1926 | Vishner et al. . | |
| 1,831,068 | 11/1931 | Haysup . | |
| 2,680,577 | 6/1954 | Friener et al. . | |
| 2,758,887 | 8/1956 | Herod . | |
| 3,197,204 | 7/1965 | Holkesvick et al. . | |
| 3,220,511 | 11/1965 | Holkesvick . | |
| 3,250,515 | 5/1966 | Hudnall | 182/5 |
| 3,351,158 | 11/1967 | Kite | 188/65.4 |
| 3,550,726 | 12/1970 | Chezem et al. . | |
| 3,931,846 | 1/1976 | Zilver | 160/178.2 |
| 3,949,832 | 4/1976 | Hunter | 182/7 |
| 4,311,217 | 1/1982 | Wood . | |
| 4,474,262 | 10/1984 | Himmelrich . | |
| 4,508,193 | 4/1985 | Forrest . | |
| 4,550,801 | 11/1985 | Forrest . | |

*Primary Examiner*—Reinaldo P. Machado
*Attorney, Agent, or Firm*—Ralph F. Crandell

[57] ABSTRACT

A descent control device for lowering a load along a rope from an elevated position at which said rope is anchored to a relatively lower position. The device includes a vertical friction capstan such as a drum, shaft or cylinder, of a length adapted to receive a plurality of turns of rope wrapped therearound. Top and bottom end plates are attached respectively adjacent the upper and lower ends of the capstan; each having a portion overhanging the surface of the capstan and defining apertures sized to loosely receive the rope. The bottom aperture includes arcuate slot which tapers as it follows the contour of the capstan. A hook or eye depends from the lower end of the capstan for attaching a load carrying device. A locking end plate is rotatably mounted on the capstan below the lower end plate and includes an aperture for loosely receiving the rope. A spring rotatably biases the locking plate to forceably urge said rope into the narrowly tapered slot in the lower end plate for locking the capstan against movement on the rope. Handles are provided on the lower end plate and the locking plate for moving the locking plate with respect to the lower end plate to position the rope in the larger apertures to release the capstan assembly for descending movement along the rope.

5 Claims, 2 Drawing Sheets

DESCENT CONTROL DEVICE WITH DEADMAN BRAKE

BACKGROUND OF THE INVENTION

1. Field of the Invention

The present invention relates to a descent control device for use in descending from a higher elevation to a lower elevation along a rope or cable, and more particularly, to a rope mounted, descent control device including a deadman brake.

2. Description of the Prior Art

A descent load lowering device in the form of a small cylindrical drum about which a rope is wound to provide a descent braking function is disclosed in U.S. Pat. No. 4,550,801, issued Nov. 5, 1985, to William E. Forrest, for "Personal High Rise Evacuation Apparatus." The device shown in the patent to Forrest includes end plates on each end of a cylindrical drum with apertures on each end plate through which a rope is threaded and wound in two or more turns around the drum. The lower end plate is provided with one or more arcuate tapered slots opening into the rope receiving aperture for engaging and binding the rope in order to provide a brake. The operator grasps and moves the free untensioned end of the rope along a tapered slot to vary the rate of descent or stop it altogether by tensioning and holding the rope in the narrow end of the arcuate tapered slot.

Tapered slots are ancient and well known in the art of releasably fastening ropes, lines and cables, such as in the nautical field where tapered slots are widely used for engaging and retaining ropes, lines, hausers and cables. The use of cylindrical capstans for holding and providing a mechanical advantage for tightening ropes is also old and well known. Likewise, a variety of fire escape devices utilizing a rope wound around a cylinder are old and well known. See, for example, U.S. Pat. No. 771,251 issued Oct. 4, 1904 to O. Howe for "Fire-Escape"; U.S. Pat. No. 386,237 issued July 17, 1888 to T. Budd for "Fire Escape"; U.S. Pat. No. 1,115,603 issued Nov. 3, 1914 to J. Smith for "Fire Escape"; and U.S. Pat. No. 536,866 issued Apr. 2, 1895 to C. FitzGerald for "Fire Escape."

OBJECTS AND SUMMARY OF THE INVENTION

It is the principal object of the present invention to produce an improved load lowering descent device embodying a cylindrical body about which a rope or cable is turned together with a deadman safety control providing a fail-safe descent device arrangement.

Another object of the invention is to provide an improved fail-safe descent control device which is simple in construction and operation and may be utilized with a minimum of effort and instruction.

A further object of the present invention is to provide an improved descent or personnel lowering device of the foregoing character which is simple in construction and operation, rugged and easy to use.

Other objects and advantages of the invention will become apparent as the following description proceeds.

The load carrying, fail safe descent control device embodying the present invention comprises a central, single cylindrical shaft or drum with upper and lower end plates securely affixed to the shaft, the upper end plate being fixed to the shaft at or adjacent to its upper end while the lower end plate is affixed to the shaft at a distance slightly spaced from the lower end of the shaft. The end plates both define a rope receiving aperture spaced radially outwardly from the surface of the shaft. The lower most end of the shaft includes a ring or other device for attaching a load. A rope extends through the upper end plate aperture, is wrapped around the shaft as a capstan for two or three turns, and extends upwardly through the aperture in the lower end plate.

For engaging and clamping the rope to stop movement of the device and supported load, the aperture in the lower end plate includes a tapered arcuate slot extending from the rope receiving aperture partially around and adjacent the surface of the drum or shaft. By forcing the rope into the tapered arcuate slot, the rope is frictionally engaged by the lower end plate and further movement of the device is prevented.

To provide a safety locking feature or a deadman feature, a locking plate is swingably mounted on the cylinder or shaft just below the lower end plate. The locking plate includes a single aperture for loosely receiving the rope, and the locking plate is normally biased to force the rope or line into a tapered slot in the lower end plate. Handles on the lower end plate and pivoted plate allow a user to swing the locking plate with respect to the lower end plate to align the rope receiving openings and allow the rope to slip through the device. When the handles are released, a spring biases the locking plate to a locking position, jamming the rope into the tapered slot in the lower end plate and positively preventing further movement of the cylinder.

If, during a descent, the user should let go of the handles on the descent device, the device would automatically and positively lock onto the rope. This would be accomplished by the spring biased action of the swinging plate forceably urging the rope into the narrow end of the tapered slot thereby securely locking the rope against movement and supporting the user on the rope at the locked position. Unless and until the device is positively actuated to release the rope, further descent is precluded.

DESCRIPTION OF THE PREFERRED EMBODIMENT

Figure 1:
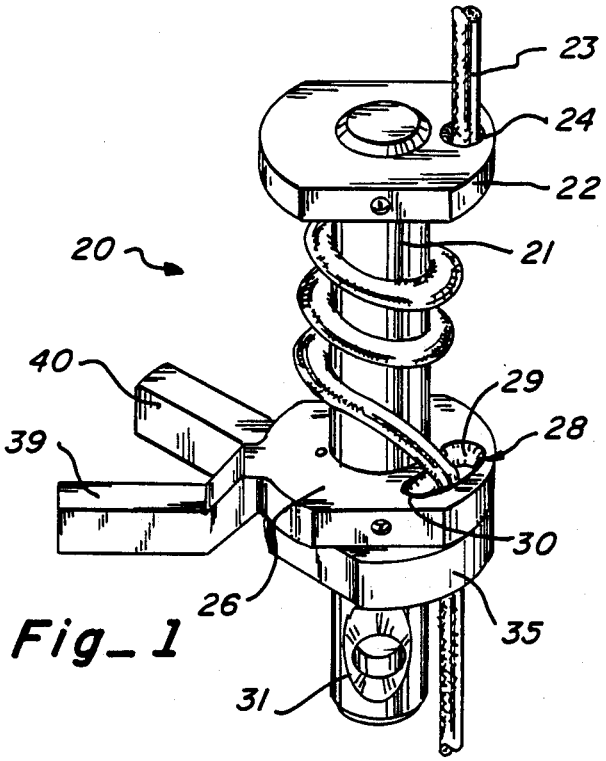
FIG. 1 is a perspective view of a descent device embodying the present invention.
Figure 6:
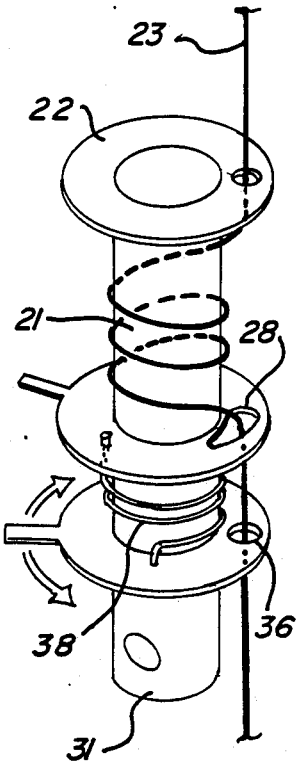
FIG. 6 is a diagramatic view of the descent device shown in FIG. 1.
Figure 2:
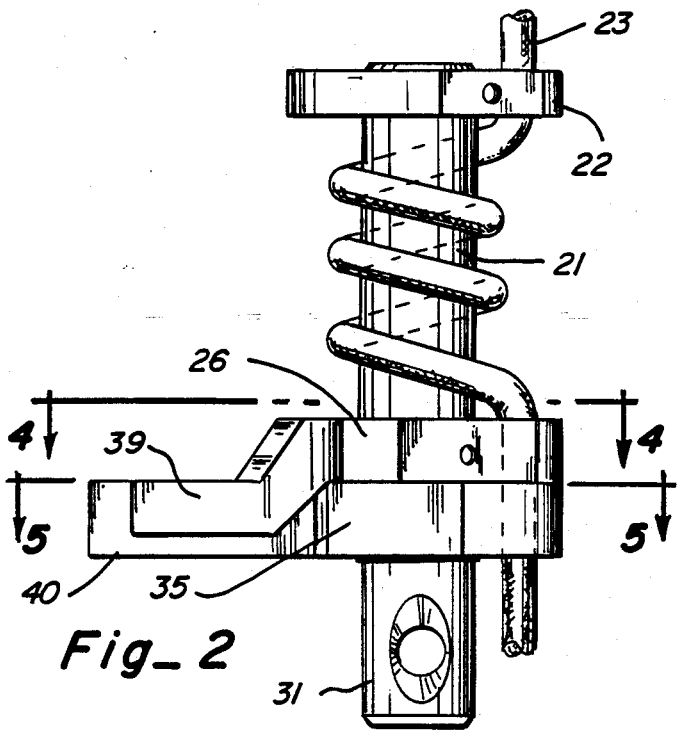
FIG. 2 is a front elevation view of the descent device shown in FIG. 1.
Figure 3:
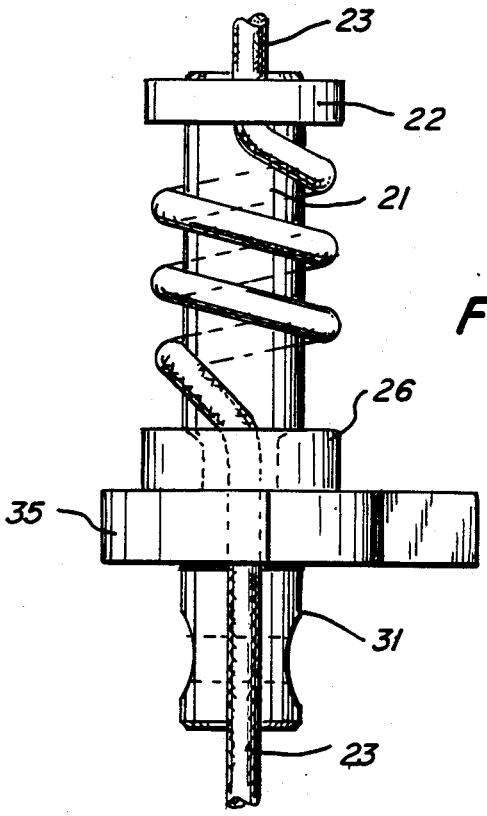
FIG. 3 is a side elevation view of the descent device shown in FIG. 1.
Figure 4:
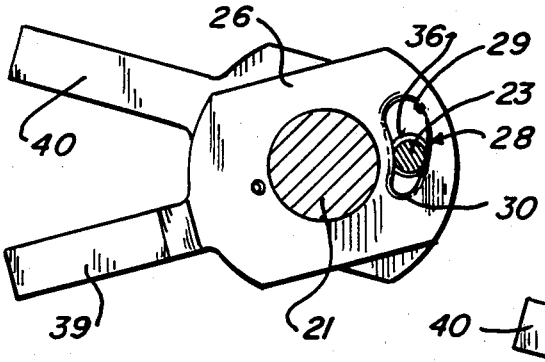
FIG. 4 is a section view taken substantially in the plane of line 4—4 on FIG. 2.
Figure 5:
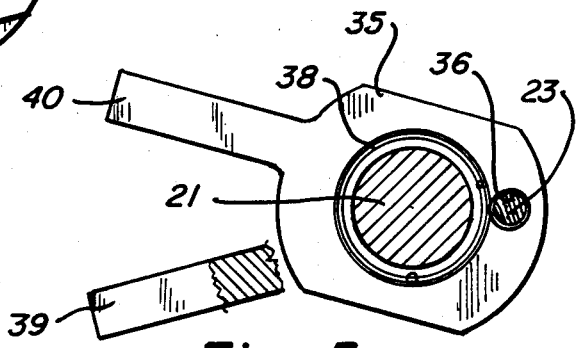
FIG. 5 is a section view taken substantially in the plane of line 5—5 on FIG. 2.

The preferred embodiment of the present invention is shown in the drawings. The descent device 20 is formed by a vertically oriented capstan 21 such as a cylinder, shaft or drum, about which a length of rope or line 23 is wound, the number of turns determining the capstan ratio or force reduction. The cylinder or shaft 21 is capped at its upper end by an upper end plate 22 having an aperture 24 therethrough for loosely receiving a length of rope or line 23. The upper plate 22 is securely affixed to the capstan 21. A lower plate 26 is secured to the capstan 21 adjacent to, but spaced from its lower end. The lower plate 26 defines an aperture 28 for receiving the rope after the rope has been wound about the capstan cylindrical surface. The aperture 28 in the lower end plate 26 is generally arcuate in shape and tapers from a larger opening 29 end for loosely receiving the rope 23, to a narrower tapered end 30 for tightly and frictionally engaging the inserted rope. At the bottom of the cylindrical capstan there is provided a mounting device 31 such as an eye or hook to which a load may be secured. For personnel descents, the load would be a harness, seat, bosun's chair or the like.

At its upper end the rope 23 is provided with appropriate means (not shown) for attaching the rope at an elevated position to a secure mounting. A user suspended from the descent device 20 can control the movement of the device along the rope by manually positioning the rope in the tapered slot or removing it from the tapered end. While to some extent the control is automatic, depending on the direction of rotation of the rope around the capstan, essentially a conscious and positive control of the rope 23 and descent device 20 by the user is required.

In order to provide a deadman or safety control feature, a second lower locking plate 35 is rotatably mounted on the capstan 21 immediately below and in close juxtaposition with the lower end plate 26. The rotatable locking plate 35 defines an aperture 36 for loosely receiving the rope which, likewise, passes through the arcuate slot 28 in the bottom fixed end plate 26. The rotatable locking end plate 35 is biased by a coil spring 38 to swing the plate to position the aperture 36 therein below the narrow tapered end 30 of the arcuate slot 28 in the fixed lower end plate 26 and thereby positively clamp the rope 23 against movement in the absence of a conscious effort to release the rope. This structure provides a safety or deadman feature in that the device is biased to a rope locking or safe position.

For swinging the rotatable end plate 35 with respect to the fixed end plate 26, appropriate handles 39, 40 are provided on the fixed end plate 26 and adjacent locking plate 35 respectively, for engagement by one or both hands of a user. By swinging the rotatable locking end plate 35 against the force of the biasing spring 38, the rope is released through the larger apertures, and the device and burden it carries can descend along the rope. Upon releasing the handles 39, 40, either deliberately or controllably, the rate of descent of the device and its burden is controlled and, if the handles are completely released, the descent movement stops.

While a certain illustrative embodiment of the present invention has been shown in the drawings and described above in detail, it should be understood that there is no intention to limit the invention to the specific form disclosed. On the contrary, the intention is to cover all modifications, alternative constructions, equivalents and uses falling within the spirit and scope of the invention as expressed in the appended claims.

We claim:

1. A descent control device for lowering a load along a rope from an elevated position at which said rope is anchored to a relatively lower position, said device including a friction cylinder of a length adapted to receive a plurality of turns of rope wrapped therearound, said cylinder having an upper end and a lower end, top and bottom end plates attached respectively adjacent the upper and lower ends of said cylinder, said end plates both having a portion thereof overhanging the cylinder and defining apertures sized to loosely receive the rope, the aperture defined in the bottom plate including an arcuate slot with an entryway of a width adapted to freely admit the rope and tapering from said entryway as it follows the contour of the cylinder partially therearound to a relatively narrower blind end, and means depending from the lower end of said cylinder for attaching a load carrying device, wherein the improvement comprises, a locking end plate rotatably mounted on said cylinder below said lower end plate in close juxtaposition therewith, means defining an aperture in said locking plate for loosely receiving the rope, means biasing said locking plate to rotate said plate to forceably urge said rope into the narrowly tapered slot in said lower end plate for locking said cylinder against movement on said rope, and handles on said lower end plate and said locking plate for moving said locking plate with respect to said lower end plate to position said rope in the aperture in said lower end plate to release said cylinder for controlled movement along said rope.

2. A descent control device for lowering a load along a rope from an elevated position at which said rope is anchored to a relatively lower position, said device including a friction cylinder of a length adapted to receive a plurality of turns of rope wrapped therearound, said cylinder having an upper end and a lower end, top and bottom end plates attached respectively adjacent the upper and lower ends of the cylinder, said end plates both having a portion thereof overhanging the drum and defining apertures sized to loosely receive the rope, the aperture in the bottom plate including an arcuate slot with an entryway of a width adapted to freely admit the rope and tapering from said entryway as it follows the contour of the cylinder partially therearound to a relatively narrower blind end, and means depending from the lower end of said cylinder for attaching a load carrying device, wherein the improvement comprises a locking end plate rotatably mounted on said cylinder below said lower end plate in close juxtaposition therewith, means defining an aperture in said locking plate for loosely receiving the rope, means biasing said locking plate to rotate said plate to position said rope into the narrowly tapered slot in said lower end plate for locking said cylinder against movement on said rope, and means on said locking plate for swinging said locking plate relative to said end plate to release said rope from said arcuate slot whereby said device controllably descends the rope.

3. A descent control device for lowering a load along a rope from an elevated position at which said rope is anchored to a relatively lower position, said device including a friction drum of a length adapted to receive a plurality of turns of rope wrapped therearound, said drum having an upper end and a lower end, top and bottom end plates attached respectively adjacent the upper and lower ends of the drum, said end plates both having a portion thereof overhanging the drum and defining apertures sized to loosely receive the rope, the aperture in the bottom plate including an arcuate slot with an entryway of a width adapted to freely admit the rope opening into the latter and tapering from said entryway as it follows the contour of the drum partway therearound to a relatively narrower blind end, and means depending from the lower end of said drum for attaching a load carrying device, wherein the improvement comprises means mounted on said drum below said lower end plate for releasably biasing said rope into the narrowly tapered slot in said lower end plate thereby releasably locking said drum against movement on said rope.

4. A descent device as defined in claim 3, wherein said releaseable locking means comprises a locking plate rotatably mounted on said drum below said lower end plate and in close juxtaposition therewith, said locking plate in defining a rope receiving aperture for controlling the positioning said rope relative to of said lower end plate.

5. A descent device as defined in claim 4 wherein said locking plate and said lower end plate include means cooperatively actuable for moving said locking plate with respect to said end plate to position said rope in said lower end plate aperture to release said drum for controlled movement along said rope.

* * * * *